US006258214B1

(12) United States Patent
Winheim et al.

(10) Patent No.: US 6,258,214 B1
(45) Date of Patent: Jul. 10, 2001

(54) PROCESS FOR THE ON-LINE MANUFACTURE OF SC-A PAPER

(75) Inventors: Stefan Winheim; Rudolf Mann, both of Frankfurt am Main (DE)

(73) Assignee: V.I.B. Apparatebau GmbH, Maintal (DE)

( * ) Notice: Subject to any disclaimer, the term of this patent is extended or adjusted under 35 U.S.C. 154(b) by 0 days.

(21) Appl. No.: 09/406,291

(22) Filed: Sep. 24, 1999

Related U.S. Application Data

(62) Division of application No. 09/141,306, filed on Aug. 27, 1998, now Pat. No. 6,073,549.

(30) Foreign Application Priority Data

May 8, 1998 (DE) ..... 198 20 606

(51) Int. Cl.[7] ..... D21H 25/12

(52) U.S. Cl. ..... 162/207; 162/204; 162/198; 162/136; 700/128; 427/361

(58) Field of Search ..... 162/204–207, 162/DIG. 10, 252, 198, 136, 35, 183–185; 100/41, 137, 73, 194, 92, 327, 16 R, 38, 74, 75, 303–304, 331; 700/127–129; 427/391, 361, 366; 34/114, 117, 120; 226/97.3

(56) References Cited

U.S. PATENT DOCUMENTS 3,948,721 * 4/1976 Winheim ..... 162/207
4,375,188 * 3/1983 Leiviska ..... 100/162 R
4,492,612 * 1/1985 Matarainen ..... 162/361
4,738,197 * 4/1988 Malkia ..... 100/38
4,749,445 * 6/1988 Vreeland ..... 162/206
4,982,334 * 1/1991 Balakrishnan ..... 364/471.03
5,076,888 * 12/1991 Korpela ..... 162/135
5,163,365 * 11/1992 Taylor ..... 100/38
5,914,008 * 6/1999 Winheim ..... 162/206

OTHER PUBLICATIONS

Ruthfuss U., "A review of surface charateristics and printing results from soft and supercalendered papers" (Abstract only), in Finishing and Coverting Conference, Chicago Oct. 2–4, 1994.*

* cited by examiner

*Primary Examiner*—Jose Fortuna
(74) *Attorney, Agent, or Firm*—Friedrich Kueffner

(57) ABSTRACT

A process for the manufacture of SC-A paper having a high gloss and high smoothness, wherein the paper arriving from the paper machine is supplied on-line to a supercalender (multinip soft calender), and wherein the paper travels through a plurality of nips for achieving the desired gloss and smoothness properties. The paper web arriving from the paper machine and supplied on-line to a supercalender (multinip soft calender) is moistened with steam immediately prior to the first nip of the supercalender and is guided through the first nip before the increased moisture of the surface resulting from the application of steam has dropped below a predetermined value in the range of 12% to 25%.

11 Claims, 1 Drawing Sheet

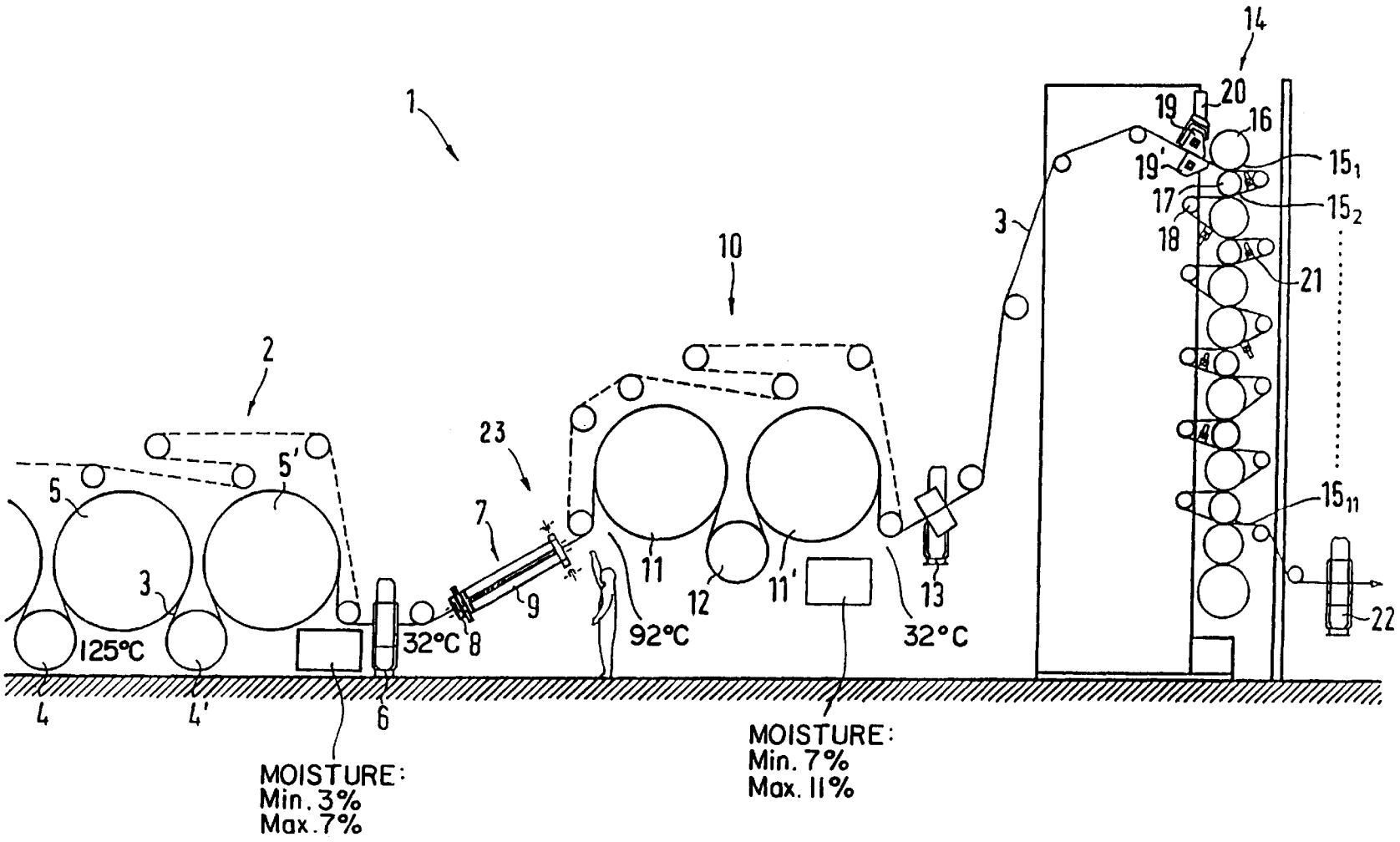
MOISTURE:
Min. 7%
Max. 11%
MOISTURE:
Min. 3%
Max. 7%
32°C
92°C
32°C
125°C

PROCESS FOR THE ON-LINE MANUFACTURE OF SC-A PAPER

This application is a division of Ser. No. 09/141,306, filed on Aug. 27, 1998 now U.S. Pat. No. 6,073,549.

BACKGROUND OF THE INVENTION

1. Field of the Invention

The present invention relates to a process for the manufacture of SC-A paper having a high gloss and high smoothness, wherein the paper arriving from the paper machine is supplied on-line to a supercalender (multinip soft calender), wherein the paper travels through a plurality of nips for achieving the desired gloss and smoothness properties.

The present invention also relates to an apparatus for carrying out the process.

2. Description of the Related Art

Gloss and smoothness are characteristics of a paper web which not only influence the appearance of the paper web but also the possibilities of further processing of the paper web. In certain types of applications, gloss and/or smoothness values are desired which are to be reproducible as uniformly as possible.

Gloss and smoothness of the paper web are usually increased by conducting the paper web following the dry end of the paper machine into a smoothing unit which is composed of one or more nips, wherein the gloss and/or the smoothness of the paper web is increased by the pressure in the nip and the temperature of the rolls forming the nip. However, this makes it only possible to influence the gloss and smoothness of the paper web to a limited extent because, when the pressure in the nip is increased too much, the paper web is compressed too much and a volume loss of the paper web occurs. In this connection, there is the danger that the paper web loses stability. There are also limits with respect to the increase of the roll temperature because this increase requires a large amount of energy. For example, for achieving roll temperatures of 200° C., significant quantities of energy must be supplied because the rolls are continuously cooled by the paper web travelling past the rolls.

Therefore, it has already been attempted, for example, in silicon papers, to influence the gloss and smoothness of the paper web by the moisture of the paper web. However, this has the disadvantage that after the treatment the supplied moisture has to be removed at least partially which requires additional process steps which, in turn, increase the time required for the treatment of the paper web and the apparatus is more complicated.

Basically, there are essentially two types of smoothing units. So-called supercalendars have a plurality of rolls arranged one above the other and nips provided between the rolls through which the paper web travels. The large number of nips produces a high degree of overlap or contact and a good distribution of the glazing work between pressure and temperature. Supercalenders are usually provide off-line, i.e., the paper web arriving from the paper machine is initially wound onto a reel-spool and is transferred together with the reel-spool to the supercalender, wherein the paper web travels through the supercalender at a significantly lower speed than the paper machine speed. The off-line installation has the advantage that the paper web can level out or equalize prior to entering the supercalender, so that the operation in the supercalender does not have to be carried out under the requirements of the paper machine which is influenced by many factors. However, the installation requirements are significantly higher. A supercalender classically has heated steel rolls, on the one hand, and paper rolls or rolls covered with cotton, on the other hand. More recently, also so-called multinip soft calenders are used in which the paper rolls are replaced by rolls having polymer covers. These rolls have a different elastic behavior than the paper rolls, so that it is possible to operate with a lower nip pressure.

Secondly, there are so-called machine calenders or soft calenders which can be connected on-line to a paper machine and through which, consequently, the paper web travels with the paper machine speed. However, machine calenders only have a small number of nips, so that the operation is carried out with higher pressure and temperature and, thus, the paper web is stressed to a greater extent. A significant disadvantage of the soft calenders is that not all types of paper can be upgraded to high qualities. In particular, it is not possible to manufacture highly compacted SC-A paper on-line in a soft calender. It was possible recently to achieve the printing properties of a natural gravure paper supercalendered in 11 nips in a soft calender with only four nips; however, this requires relatively high roll temperatures and compressive stresses in the nips. Also, these qualities can only be achieved in a range of speeds which corresponds to the glazing speed in the supercalender which is usual for this paper (see: Rothfuss, Ulrich: Inline- und Offline-Satinage von holzhaltigen, tiefdruckfähigen Naturdruckpapieren in: Wochenblatt für Paperfabrikation 1993, No. 11/12, pages 457–466). Consequently, such qualities can only be achieved with the off-line installation of the soft calender.

SUMMARY OF THE INVENTION

Therefore, it is the primary object of the present invention to manufacture SC-A paper on-line. (SC paper stands for supercalender paper wherein a distinction is made between SC-A and SC-B papers, with brightness and lightness being the same but smoothness and gloss being higher for the SC-A paper, typically in the range of 40–50 Hunter gloss points, and comparable to the values of LWC paper).

In accordance with the present invention, the paper web arriving from the paper machine and supplied on-line to a supercalender (multinip soft calender) is moistened with steam immediately prior to the first nip of the supercalender and is guided through the first nip before the increased moisture of the surface resulting from the application of steam has dropped below a predetermined value in the range of 12% to 25%.

Paper is a voluminous fiber structure with differing behaviors in the thickness direction. Thus, in accordance with a simplification, SC-A paper with a material weight of about 50 g/m$^2$ could be considered to have three portions or layers arranged one above the other. The paper surface is considered to be the uppermost portion of the paper, i.e., the upper third of the material web in the case of the aforementioned SC-A paper. After the application of steam, the moisture has the tendency to even out over the cross-section of the material web, wherein it is provided in accordance with the present invention that the paper web enters the first nip before the moisture of the surface (upper third of the material web) has dropped to a predetermined value of 12% to 25%. Because of the moisture gradient between the paper web surface and the middle portion of the paper web, the surface can be processed more intensely in the nip for achieving better gloss and smoothness properties, while the middle portion of the paper web ensures sufficient stability.

In accordance with the process of the present invention, the paper web is not only moistened, but a temperature increase is achieved simultaneously. The heat contained in the steam is transferred during the condensation onto the paper web, so that this measure produces a paper web which has at the surface thereof the necessary temperature and the necessary moisture. When this paper web is guided through the nip, the nip primarily influences the surface portion of the paper web, while the middle and lower portions are influenced significantly less than in conventional processes. Consequently, no changes worth mentioning occur in the thickness direction in the middle (and lower) portions. The volume of the paper web is maintained to a greater extent, although the surface quality is significantly improved. The rolls have to be heated significantly less and the pressure in the nip can be selected lower than in the past. This saves significant energies. It is possible to compute (finite elements method) or it can be determined empirically how long it takes until the moisture penetrates into the interior of the web. However, before this state is reached, the web, or more precisely its surface, has already been treated in the nip. Since the application of steam occurs immediately prior to the paper web entering the nip, the surface of the web still has a relatively high temperature and has a relatively high moisture, so that the increase of the gloss and/or smoothness can also be carried out at lower pressures and lower temperatures in the nip. On the other hand, the web taken as whole does not absorb significant quantities of moisture, so that complicated aftertreatments are not required. The energies required for changing the surface are kept within the range which is to be converted, i.e., smoothed. The remaining parts of the web are not impaired or only to a small extent.

The present invention utilizes concepts which are known from DE 43 01 023 C2 with respect to machine calenders. This process also already provides to apply steam to the paper web immediately prior to the nip and to conduct the paper web through the nip before the temperature and moisture have equalized in the paper web. However, the on-line manufacture of SC-A papers is not possible with machine calenders of this type. It has now been found that this process known for machine calenders permits such a gentle treatment of the paper web that the paper web can be supplied on-line to a supercalender even without the previously conventional significant drying, so that an on-line manufacture of SC-A paper becomes possible.

In accordance with a preferred further development of the invention, the paper web is guided through the first nip of the supercalender before the temperature increase in the middle third of the paper web caused by the application of steam has reached 1/e (e is the natural logarithm constant 2.71828 . . . ) times the temperature increase at the surface. The temperature pattern over the paper web can also be determined by computation or empirically. The influence on the gloss and smoothness of the paper web surface can be further improved by the double temperature and moisture gradient.

In accordance with an advantageous feature, the paper web is cooled at the supercalender prior to the application of steam in order to increase the temperature gradient.

In accordance with a supplemental feature, the temperature of the calender roll or steel roll in the first nip of the supercalender is greater than 125° C., preferably about 150° C., in order to remove the high moisture from the web surface. Simultaneously, the temperature gradient and, thus, the smoothness and gloss improvement are increased.

Since the paper web leaves the dry end of the paper machine with a relatively high temperature of, for example, 125° C., the present invention provides for an intermediate cooling to reduce the web temperature preferably to about 30° C.

Since the gentle treatment of the paper web by the process according to the present invention makes it possible to supply the paper web to the supercalender with a higher initial moisture, the present invention further provides that the paper web is remoistened after leaving the dry end of the paper machine, and after intermediate cooling as necessary, and the paper web is (once again) intermediately cooled prior to entering the supercalender. This makes possible an increased moisture content, i.e., a better deformability, of the paper web, while simultaneously ensuring a sufficient temperature gradient at the first nip of the supercalender.

In accordance with a further development of the invention, remoistening of the paper web after the dry end is carried out in a steam applicator in which initially steam is applied onto the paper web and the paper web is then conducted through a heat duct with hot saturated air. This makes it possible that the moisture can level out over the entire cross-section of the paper web. The saturated air is withdrawn again at the end of the heat duct.

Since the moisture of the paper web is decreased each time the paper web travels through a nip in the supercalender, the present invention additionally provides that the paper web is remoistened with steam in the supercalender. The moistening with steam influencing essentially the surface of the paper web makes possible a gentle treatment of the paper web and an additional increase of the smoothness and gloss improvement in the roll gap.

The present invention further provides that the moisture of the paper web is determined following the intermediate cooling section or sections and that the application of steam during remoistening and/or prior to the first nip of the supercalender is regulated in dependence on the determined actual moisture values and predetermined nominal values.

In accordance with a supplemental feature, the gloss and/or the smoothness of the paper web is determined following the supercalender and the application of steam is regulated in dependence on the determined actual values and the predetermined nominal values.

In a paper machine having a dry end and a supercalender (multinip soft calender) with a plurality of nips arranged on-line following the dry end, the apparatus according to the present invention for the on-line manufacture of SC-A paper meets the object described above by providing an intermediate cooling section following the dry end of the paper machine for reducing the temperature of the paper web, wherein a steam application device is arranged following the intermediate cooling section for increasing the moisture of the paper web, and wherein a steam delivery device is provided immediately prior to the first nip of the supercalender, so that the temperature increase and moisture increase of the paper effected by the steam application has not yet been equalized when the paper web travels through the nip.

In accordance with the invention, the steam application device is followed by a second cooling section in order to once again reduce the web temperature prior to the supercalender. By cooling the web prior to the application of steam at the first nip of the supercalender, a sufficient quantity of steam is condensated. The moisture and temperature gradient achieved by the application of steam is maintained up to the first nip because the steam application only takes place immediately in front of the first nip of the supercalender, so that an equalization or levelling out of the temperature and the moisture is not possible.

In accordance with a further development of the invention, a measuring frame is provided following the first intermediate cooling section and/or following the second cooling section, wherein the measuring frame determines the moisture of the paper web, and wherein the determined measurement values are utilized for controlling the steam application device and/or the steam delivery device. This makes it possible to adapt the steam application always to the actual requirements.

In accordance with another feature of the invention, a measuring frame for determining the gloss and/or smoothness of the paper web is arranged following the supercalender, wherein the measurements determined by this measuring frame are utilized for controlling the steam discharge device in order to be able to directly correct undesired gloss or smoothness changes. Additionally, the temperature of the rolls may be adapted on the basis of the determined measurement values.

In accordance with a preferred further development of the invention, a steam discharge device each is arranged on both sides of the paper web in front of the first nip of the supercalender, so that the improvements of the gloss and smoothness properties take place simultaneously on the upper side as well as on the bottom side of the paper web.

Since the efficiency of the steam delivery device is limited, i.e., the paper web does not absorb the entire delivered steam, a suction means for removing the oversaturated air is provided especially in the above-described sandwich construction with steam delivery devices on the upper and lower sides of the paper web. Otherwise there would be the danger of the formation of droplets which would lead to damage of the paper web.

In accordance with a further development of the invention, additional steam delivery devices for remoistening the paper web are provided in the supercalender prior to additional nips, so that the surface improvements in these nips are reinforced according to the present invention.

In accordance with the invention, the steam application device provided following the dry end for remoistening the paper has at the entry side thereof a steam delivery device which is followed by a heating duct through which the paper web travels. This ensures that the moisture applied by the steam delivery device cannot level out over the cross-section of the paper web.

In accordance with the invention, this operation is further reinforced by providing that hot saturated air is introduced into the heating duct, wherein the air is withdrawn at the end of the heating duct.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic illustration of the apparatus according to the present invention for the on-line manufacture of SC-A paper.

DESCRIPTION OF THE PREFERRED EMBODIMENTS

An apparatus 1 for the on-line manufacture of the SC-A paper includes a paper machine, wherein the drawing only shows the last section of the dry end of the paper machine. The specific configuration of the paper machine is not material with respect to the present invention.

The dry end of the paper machine is followed by an intermediate cooling section 2 through which a paper web 3 travels. In the illustrated section, the paper web 3 travels around two suction rolls 4, 4' and two cooling rolls 5, 5' which cause the temperature of the paper web 3 to drop from 125° C. to 32° C. At the end of the intermediate cooling section 2, the paper web has a moisture of 3% to 7%, wherein the moisture is measured by a moisture measuring frame 6.

Following the intermediate section 2, the paper web 3 travels through a steam application device 7 which at the entry side thereof has a steam delivery device 8 and, following the steam delivery device 8, a heating duct 9 which is filled with hot saturated air. A suction means 23 is provided at the end of the heating duct 9. After traveling through the steam application device 7, the paper web 3 has a temperature of 92° C., i.e., the temperature was raised in the steam application device 7 by about 60° C. Simultaneously, the moisture of the paper web 3 was also increased by the application of steam.

Following the steam application device 7, the paper web 3 travels through a second cooling section 10 which, in the illustrated embodiment, includes two cooling rolls 11, 1140 and a suction roll 12 arranged between the cooling rolls 11, 11'. In the cooling section 10, the temperature of the paper web 3 is once again cooled down to about 32° C., wherein the paper web 3 has at the end of the cooling section 10 a moisture of 7% to 11.5%. The moisture content of the paper web 3 is determined by a measuring frame 13.

Subsequently, the paper web 3 travels on-line into a supercalender 14. The supercalender 14 has a plurality of nips 15 which are successively travelled through by the paper web 3. The supercalender referred to is a multinip soft calender. Each nip 15 is formed by a polymer roll 16 and a steel roll 17 which is heated to at least 125° C., preferably up to 150° C.

Guide rolls 18 are provided for guiding the paper web 3 through the appropriate nips.

A steam delivery device 19 is provided immediately in front of the first nip $\mathbf{15}_1$ of the supercalender 14. The steam delivery device 19 may particularly be composed of a steam blowing box as it is described in DE 43 01 023 C2. In the illustrated embodiment, the steam delivery devices 19, 19' are arranged on the upper side and the bottom side of the paper web 3. However, it is also possible to provide only one steam delivery device 19 on the upper side of the paper web 3. A suction means 20 for removing the oversaturated air is provided at the steam delivery device 19, 19'.

Additional steam delivery devices 21 are provided in the supercalender 14 in front of additional nips $\mathbf{15}_2$, $\mathbf{15}_3$, $\mathbf{15}_4$, $\mathbf{15}_6$, $\mathbf{15}_7$, $\mathbf{15}_9$. These additional steam delivery devices 21 remoisten the paper web 3 in order to partially compensate for the moisture loss in the nips 15.

Following the supercalender 14 is provided a measuring frame 22 for determining the gloss and/or smoothness of the paper web 3.

Instead of the supercalender 14 illustrated in FIG. 1, it is also possible to use a so-called double-stack supercalender in which two groups of nips are arranged following each other through which the paper web travels successively. This reduces the structural height of the calender. The apparatus 1 otherwise remains unchanged. The process according to the present invention can be carried out in a double-stack calender in the same manner as in the calender illustrated in the drawing.

In the following, the manner of operation of the apparatus 1 according to the present invention will be described.

The paper web 3 emerging in the conventional manner from the dry end of the paper machine initially travels through the intermediate cooling section 2 where the temperature of the paper web 3 is lowered to 32° C. In the following steam application device 7, the paper web 3 is moistened and heated. The paper web 3 travels through the heating duct 9 in order to ensure that the moisture is levelled out over the cross-section of the paper web 3. The paper web 3 leaves the steam application device 7 with a temperature of about 92° C. This temperature would normally impair the gloss and smoothness increase in the supercalender 14 because an insufficient quantity of steam would condensate in front of the first nip $\mathbf{15}_1$. For this reason, the temperature of the paper web 3 is once again lowered to about 32° C. in the second cooling section 10, wherein the paper web has a moisture of about 7% to 11.5%.

Immediately prior to the first nip $\mathbf{15}_1$ of the supercalender 14, the steam delivery device 19, 19' applies hot steam which is free of droplets onto the surface of the paper web, wherein the steam temperature in the steam blowing chamber of the steam delivery device 19, 19' is approximately in the range of 102° C. to 110° C. in order to exclude a condensation of the steam. The steam delivery device 19, 19' is now moved as close as possible to the nip $\mathbf{15}_1$, wherein the distance can be adjusted in dependence on the speed with which the paper web 3 travels through the nip 15. The steam emerging from the steam delivery device 19, 19' spreads out with a relatively uniform pressure and a uniformly high speed of, for example, 25 m/s or more. As soon as the steam comes into contact with the relatively cold paper web 3, the steam condensates and causes the temperature at the surface of the paper web 3 to increase drastically. In the case of a paper web 3 having a temperature of about 30° C., the surface will have increased to a temperature of about 90° C. after the condensation of the steam. Simultaneously, the condensated steam forms a moisture film whose thickness is, for example, in the range of one thousandth of a millimeter. The condensation produces an almost explosive temperature increase of the surface of the paper web 3 which, however, evens out within a very short time over the thickness of the paper web 3, so that the paper web has within fractions of a second a uniform temperature distribution. The levelling out of the moisture takes somewhat longer because the moisture penetrates more slowly into the paper web 3 than the temperature. This is why the uppermost layer (approximately a third of the paper web in a SC-A paper having a material weight of about 50 $g/m_2$) has a significantly higher relative moisture than the middle portion of the paper web 3. The more the moisture penetrates into the interior of the paper web 3, the more the relative moisture decreases. However, before the moisture of the surface of the paper web 3 (upper third, or lower third in the case of steam application from below) has dropped below a predetermined value in the range of 12% to 25%, particularly of 16% to 25%, the paper web 3 travels through the first nip $\mathbf{15}_1$ of the supercalender 14. The temperature of the paper web 3 has at this point in time also not yet levelled out; rather, the temperature increase in the middle third of the paper web resulting from the steam application should not have yet reached 1/e times the temperature increase of the surface of the paper web 3.

The treatment of the paper web in the first nip $\mathbf{15}_1$ of the supercalender causes the surface of the web 3, which still has the increased temperature and moisture, to be smoothed and to be provided with an increased gloss. The portions of the paper web 3 located further in the interior thereof are not significantly changed by the nip $\mathbf{15}_1$. The paper web 3 subsequently travels through the additional nips $\mathbf{15}_2$ through $\mathbf{15}_{11}$ of the supercalender 14, wherein the paper web 3 is remoistened in front of individual nips by the steam delivery device 21 in order to improve the increase of the gloss and smoothness.

The steam discharge by the steam delivery devices 19, 1940 and/or 21 and, if applicable, heating of the calender rolls 17, are controlled on the basis of the determined measurement values of the measuring frame 22 and the predetermined nominal values. Similarly, moisture values determined by the measuring frames 6 and 13 together with appropriately predetermined nominal values serve for controlling the steam application in the steam application device 7 and the steam delivery device 19, 19'.

The present invention makes it possible to manufacture SC-A paper on-line, wherein gloss values of 48 to 50 Hunter gloss points (SC-A) are possible, and wherein even 50 to 52 Hunter gloss points (SC-A+) can be achieved when carrying out the remoistening and intermediate cooling steps. This is achieved substantially by the gentle treatment of the paper web with high moisture and temperature in the surface portions, which make it possible to supply to the supercalender a paper web having a high initial moisture.

While specific embodiments of the invention have been shown and described in detail to illustrate the inventive principles, it will be understood that the invention may be embodied otherwise without departing from such principles.

I claim:

1. A process of manufacturing SC-A paper, the process comprising introducing a paper web arriving from a paper machine on-line into supercalender and conducting the paper web in the supercalender through a plurality of nips for achieving desired gloss and smoothness properties, further comprising cooling the paper web in an intermediate cooling device after leaving a dry end of the paper machine, remoistening the paper web with steam applied by a steam application device downstream of the intermediate cooling device, cooling the paper web in a second cooling device downstream of the steam application device, subsequently moistening the paper web immediately prior to a first of the nips of the supercalender with steam and conducting the paper web through the first nip before moisture of the surface of the paper web, produced by moistening with steam immediately prior to a first of the nips, has dropped below a predetermined value in the range of 12% to 25%.

2. The process according to claim 1, comprising conducting the paper web through the first nip before a temperature increase in a middle third of the paper web resulting from moistening with steam has reached 1/e times a temperature increase at the surface.

3. The process according to claim 1, wherein the first nip is formed by a steel roll, wherein a temperature of the steel roll is greater than 125° C.

4. The process according to claim 1, wherein the first nip is formed by a steel roll, wherein a temperature of the steel roll is about 150° C.

5. The process according to claim 1, wherein in the step of cooling the paper web in an intermediate cooling device after leaving a dry end of the paper machine is cooled to a temperature of below 50° C.

6. The process according to claim 1, wherein in the step of cooling the paper web in an intermediate cooling device after leaving a dry end of the paper machine is cooled to a temperature of about 30° C.

7. The process according to claim 1, wherein the steam application device has a steam-delivery device and a heating duct, the process further comprising carrying out remoistening of the paper web by initially applying steam onto the paper web with the steam-delivery device, and subsequently conducting the paper web through the heating duct filled with hot saturated air.

8. The process according to claim 7, comprising withdrawing the saturated air following the heating duct.

9. The process according to claim 1, comprising remoistening the paper web in the supercalender using steam.

10. The process according to claim 1, comprising determining the moisture of the paper web at least one of following the intermediate cooling after the paper machine and following once again intermediate cooling the paper web, and controlling the application of steam at least in one of the remoistening and prior to the first nip of the supercalender in dependence on determined actual moisture values and predetermined nominal values.

11. The process according to claim 1, comprising determining at least one of the gloss and the smoothness of the paper web following the supercalender, and controlling the application of steam in dependence on determined actual values and predetermined nominal values.

* * * * *